US010997865B2

(12) United States Patent
Boozarjomehri et al.

(10) Patent No.: US 10,997,865 B2
(45) Date of Patent: May 4, 2021

(54) AIRPORT CONGESTION DETERMINATION FOR EFFECTING AIR NAVIGATION PLANNING

(71) Applicant: The Boeing Company, Chicago, IL (US)

(72) Inventors: Elham Boozarjomehri, Vancouver (CA); Veronica MacInnis, North Vancouver (CA); Nina Rajabi Nasab, Vancouver (CA); Ziqian Zhu, Vancouver (CA)

(73) Assignee: The Boeing Company, Chicago, IL (US)

( * ) Notice: Subject to any disclaimer, the term of this patent is extended or adjusted under 35 U.S.C. 154(b) by 357 days.

(21) Appl. No.: 15/815,180

(22) Filed: Nov. 16, 2017

(65) Prior Publication Data

US 2019/0147748 A1 May 16, 2019

(51) Int. Cl.
*G08G 5/00* (2006.01)

(52) U.S. Cl.
CPC ..... *G08G 5/0034* (2013.01); *G08G 5/0004* (2013.01); *G08G 5/0039* (2013.01); *G08G 5/0043* (2013.01); *G08G 5/0091* (2013.01)

(58) Field of Classification Search
CPC .. G08G 5/0034; G08G 5/0004; G08G 5/0039; G08G 5/0091; G08G 5/0013;
(Continued)

(56) References Cited

U.S. PATENT DOCUMENTS 6,278,965 B1 * 8/2001 Glass ..... G06Q 10/025 701/120
6,393,359 B1 * 5/2002 Flynn ..... G08G 5/0043 701/120

(Continued)

FOREIGN PATENT DOCUMENTS

WO WO-2014115139 A1 * 7/2014 ..... B64D 45/0005

OTHER PUBLICATIONS

Shakeel, Shayan. "Why Weather Matters" http://www.aviationbusinessme.com/aviation-services/aviation-technology/2017/jan/4/429302.

(Continued)

*Primary Examiner* — Bhavesh V Amin
(74) *Attorney, Agent, or Firm* — Perman & Green LLP

(57) ABSTRACT

An airport congestion detection apparatus includes a predictor input module coupled to a multiple airport information system. The input module obtains from the multiple airport information system weather data for a current point in time and flight information for a predetermined airport. A controller coupled to the input module determines one or more of a number of predicted flight departures from the predetermined airport and a number of predicted flight arrivals to the predetermined airport within a future predetermined time period based on the weather data for the current point in time and the flight information, and determines, from the predictions, a congestion index for the predetermined airport. A user interface coupled to the controller presents to an operator of the airport congestion
(Continued)

detection apparatus the congestion index so that one or more of a flight plan characteristic or an aircraft loading characteristic is modified based on the congestion index.

20 Claims, 5 Drawing Sheets

(58) Field of Classification Search
CPC .. G08G 5/0021; G08G 5/0026; G08G 5/0043; G08G 5/0056; G08G 5/0065; G08G 5/065; G08G 5/0082; G08G 5/0095; G08G 5/025; B64D 45/0005; B64D 45/04; G01S 13/91; G01S 7/003; G06F 17/28; G06F 3/147; G06F 16/748; G06F 16/94; G06F 16/9537; G06F 16/9558; G06F 16/957; G06F 16/9577; G06T 2207/30232; G06T 7/248; B65D 43/021; B65D 43/169; B65D 53/00; G06Q 10/06; G06Q 10/04; G06Q 10/109; G06Q 30/0201; G06Q 30/0203; G06Q 30/06; A61J 1/03; G10L 15/26; H04L 67/16; H04W 4/12; H04W 8/005
See application file for complete search history.

(56) References Cited

U.S. PATENT DOCUMENTS 6,463,383 B1 * 10/2002 Baiada ..... G06Q 10/06 701/120
9,076,327 B1 * 7/2015 Baiada ..... G08G 5/0043
9,245,242 B2 * 1/2016 Arnold ..... G06Q 50/30
9,335,917 B2 * 5/2016 Dostal ..... G06F 3/04847
9,766,630 B2 * 9/2017 Casado Magana .. G05D 1/0676
10,332,405 B2 * 6/2019 Kopardekar ..... G08G 5/006
10,354,538 B2 * 7/2019 Kusuma ..... G08G 5/065
10,607,496 B2 * 3/2020 Srinivasan ..... G08G 5/0021
10,665,114 B2 * 5/2020 Irrgang ..... G07C 5/0816
10,678,265 B2 * 6/2020 Sharma ..... G08G 5/0013
2002/0002548 A1 * 1/2002 Roundtree ..... H04W 8/005
2009/0171557 A1 * 7/2009 Brozat ..... G06Q 10/0633 701/120
2011/0130948 A1 * 6/2011 Oh ..... G08G 5/003 701/120
2011/0301829 A1 * 12/2011 White ..... G08G 5/0043 701/120
2012/0083997 A1 * 4/2012 Meador ..... G06Q 10/0631 701/120
2012/0245836 A1 * 9/2012 White ..... G08G 5/065 701/120
2014/0129058 A1 * 5/2014 Elahi ..... G08G 5/0021 701/16
2014/0309821 A1 * 10/2014 Poux ..... B64D 45/00 701/14
2015/0355832 A1 * 12/2015 Dostal ..... G01C 21/00 715/771
2016/0275801 A1 * 9/2016 Kopardekar ..... G08G 5/0069
2019/0147748 A1 * 5/2019 Boozarjomehri .... G08G 5/0004 701/120
2020/0234602 A1 * 7/2020 Irrgang ..... G08G 5/0056

OTHER PUBLICATIONS

Cox, et al. "Probabilistic Airport Acceptance Rate Prediction", AIAA Modeling and Simulation Technologies Conference, AIAA SciTech Forum, Jan. 2016 (AIAA 2016-0165).
Provan, et al. "A Probabilistic Airport Capacity Model for Improved Ground Delay Program Planning" IEEE/AIAA 30th Digital Avionics Systems Conference (DASC), 2011. DOI 10.1109/DASC.2011.6095990.
Smith, et al. "Decision Support Tool for Predicting Aircraft Arrival Rates from Weather Forecasts" IEEE, Integrated Communications, Navigation and Surveillance Conference (ICNS), 2008. DOI: 10.1109/ICNSURV.2008.4559186.

* cited by examiner

AIRPORT CONGESTION DETERMINATION FOR EFFECTING AIR NAVIGATION PLANNING

BACKGROUND

1. Field

The exemplary embodiments generally relate to aircraft flight planning and, in particular, to determining a congestion of an airport to facilitate air navigation planning through a modification of a flight plan of an aircraft and/or a modification of an aircraft loading based on the determined congestion.

2. Brief Description of Related Developments

Generally, airline dispatchers and/or air navigation service providers desire flight/air navigation planning tools that assist them in making informed decisions, with respect to, e.g., flight/air navigation planning, while operating flights at various airports. Generally, conventional flight/air navigation planning tools provide solutions or supportive information for humans planning the flights, regardless of arrival airport capacity. These conventional flight planning tools generally do not predict aircraft arrival rates under the assumption that there is no congestion at the arrival airport. These conventional flight planning tools also generally do not predict aircraft arrival rates under the assumption that the arrival airport has sufficient capacity to support the scheduled arrival demand. This may translate into suboptimal air navigation planning solutions being generated from the conventional flight/air navigation planning tools.

SUMMARY

Accordingly, apparatuses and methods, intended to address at least one or more of the above-identified concerns, would find utility.

The following is a non-exhaustive list of examples, which may or may not be claimed, of the subject matter according to the present disclosure.

One example of the subject matter according to the present disclosure relates to an airport congestion detection apparatus comprising: a predictor input module coupled to a multiple airport information system, the predictor input module being configured to obtain from the multiple airport information system weather data for a current point in time and flight information for a predetermined airport; a controller coupled to the predictor input module, the controller being configured to determine one or more of a number of predicted flight departures from the predetermined airport and a number of predicted flight arrivals to the predetermined airport within a future predetermined time period based on the weather data for the current point in time and the flight information, and determine a congestion index for the predetermined airport based on one or more of the number of predicted flight departures and a number of requested flight departures from the predetermined airport, and the number of predicted flight arrivals and a number of requested flight arrivals to the predetermined airport; and a user interface coupled to the controller, the user interface being configured to present to an operator of the airport congestion detection apparatus the congestion index so that one or more of a flight plan characteristic or an aircraft loading characteristic is modified based on the congestion index.

Another example of the subject matter according to the present disclosure relates to a predictor input module coupled to a multiple airport information system, the predictor input module being configured to obtain from the multiple airport information system weather data for a current point in time and flight information for a predetermined airport; a flight prediction module configured to determine one or more of a number of predicted flight departures from the predetermined airport and a number of predicted flight arrivals to the predetermined airport within a future predetermined time period based on the weather data for the current point in time and the flight information, and a controller coupled to the flight prediction module, the controller being configured to determine a congestion index for the predetermined airport based on one or more of the number of predicted flight departures and a number of requested flight departures from the predetermined airport, and the number of predicted flight arrivals and a number of requested flight arrivals to the predetermined airport; and a user interface coupled to the controller, the user interface being configured to present to an operator of the aircraft flight planning apparatus the congestion index so that one or more of a flight plan characteristic or an aircraft loading characteristic is modified based on the congestion index.

Still another example of the subject matter according to the present disclosure relates to an airport congestion determination method comprising: obtaining, with a predictor input module, from a multiple airport information system weather data for a current point in time and flight information for a predetermined airport; determining, with a controller coupled to the predictor input module, one or more of a number of predicted flight departures from the predetermined airport and a number of predicted flight arrivals to the predetermined airport within a future predetermined time period based on the weather data for the current point in time and the flight information; determining, with the controller, a congestion index for the predetermined airport based on one or more of the number of predicted flight departures and a number of requested flight departures from the predetermined airport, and the number of predicted flight arrivals and a number of requested flight arrivals from the predetermined airport; and presenting the congestion index to an operator, through a user interface, so that one or more of a flight plan characteristic or an aircraft loading characteristic is modified based on the congestion index.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a schematic block diagram of an airport congestion detection apparatus that may be incorporated into an aircraft flight planning apparatus and/or an air navigation planning apparatus in accordance with aspects of the present disclosure;

FIG. 2 is an exemplary flow diagram for determining a departure congestion index for flight departures leaving from a predetermined airport in accordance with aspects of the present disclosure;

FIG. 3 is an exemplary flow diagram for determining an arrival congestion index for flight arrivals arriving at a predetermined airport in accordance with aspects of the present disclosure;

Figure 4:
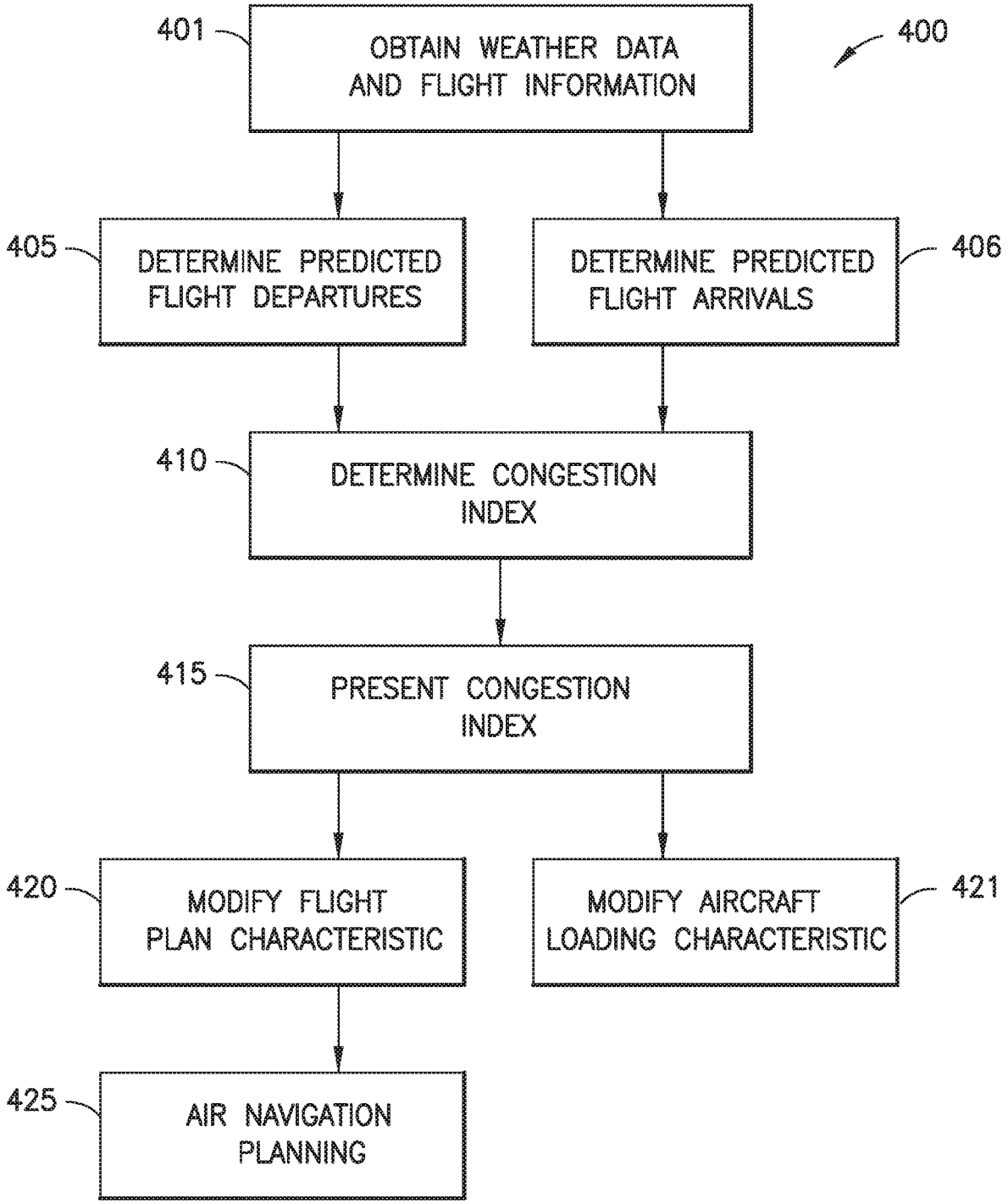
Figure 5:
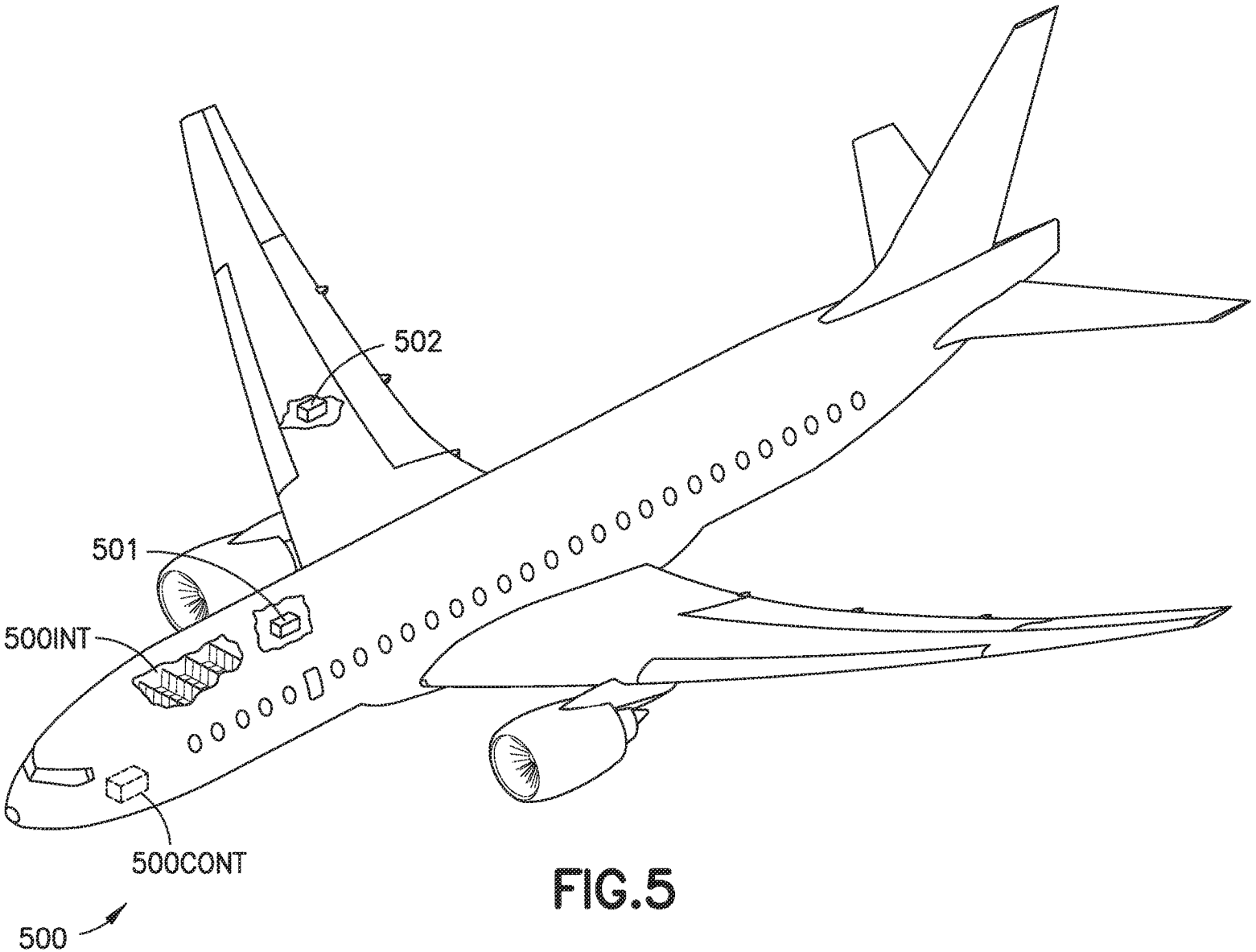

FIG. 4 is a flow diagram of a method for determining an airport congestion index and modifying at least one of air navigation planning and aircraft loading characteristics in accordance with aspects of the present disclosure; and FIG. 5 is a schematic illustration of an exemplary aircraft in or for which the aspects of the present disclosure may be employed in accordance with aspects of the present disclosure.

DETAILED DESCRIPTION

Figure 1:
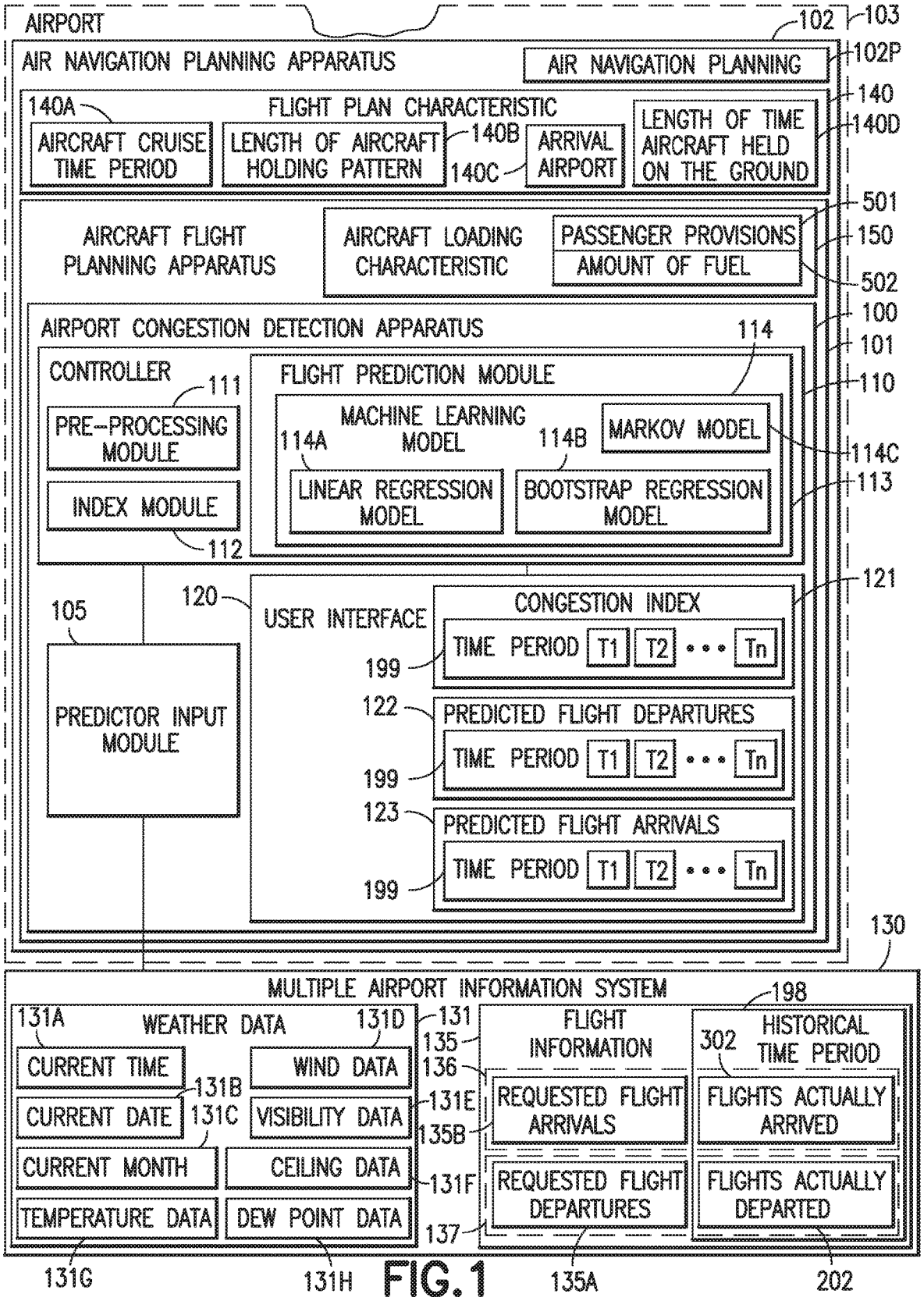

Referring to FIG. 1 the aspects of the present disclosure provide an airport congestion detection apparatus 100 for determining a congestion of a predetermined airport 103. Here the term congestion refers to the degree to which flight arrivals and/or flight departures accumulate at (e.g., clog up/impede operations at) the predetermined airport 103. The aspects of the present disclosure may be employed onboard any suitable aircraft 500 (see FIG. 5) and/or in a ground based flight control center (such as in an air navigation planning apparatus 102, where air navigation planning 102P, as used herein, includes flight planning for air traffic control at an airport and airline dispatch flight planning). While a fixed wing aircraft 500 is illustrated in FIG. 5, it should be understood that the aspects of the present disclosure may be employed in rotary wing aircraft, lighter than air aircraft, and spacecraft.

Figure 2:
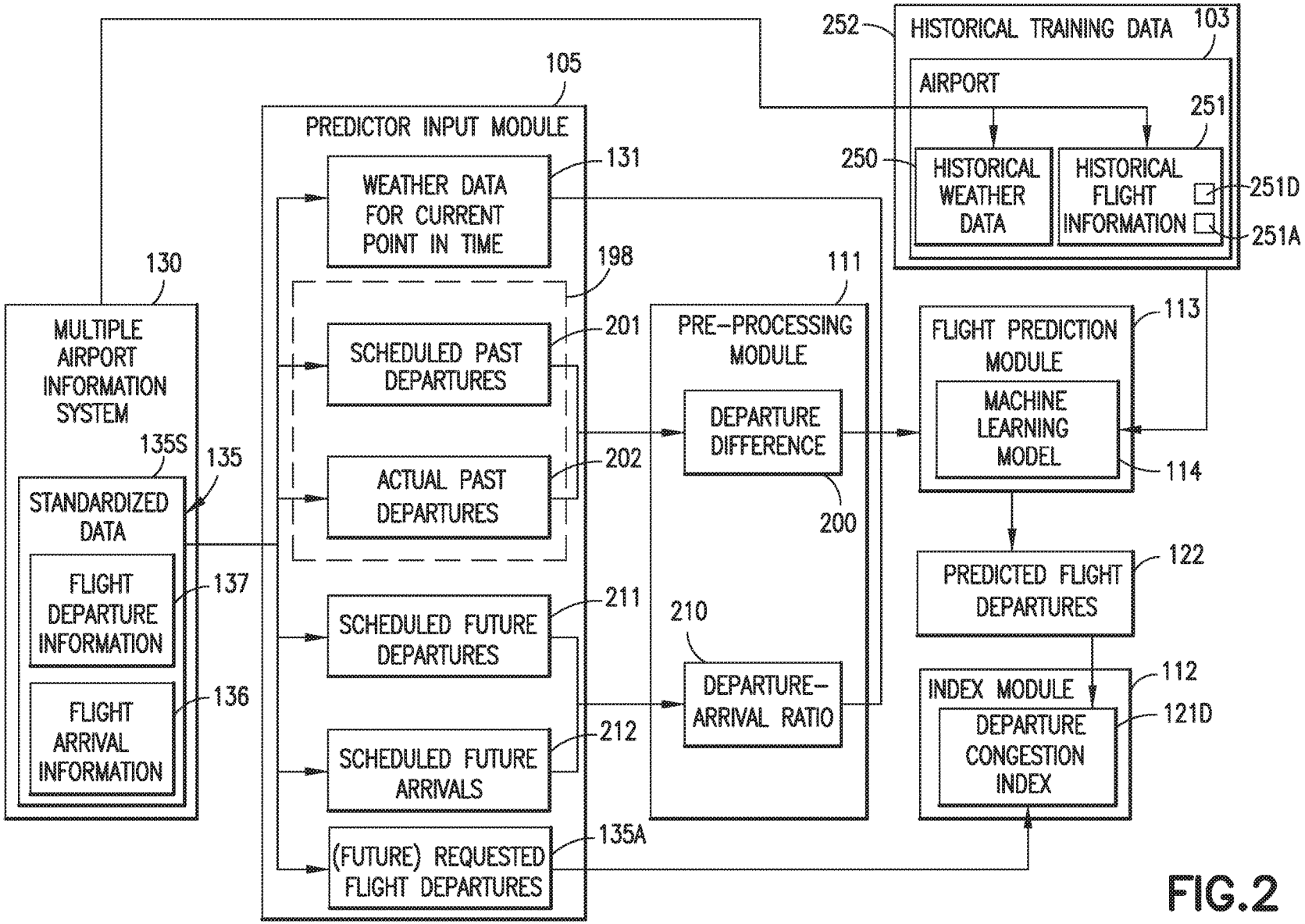
Figure 3:
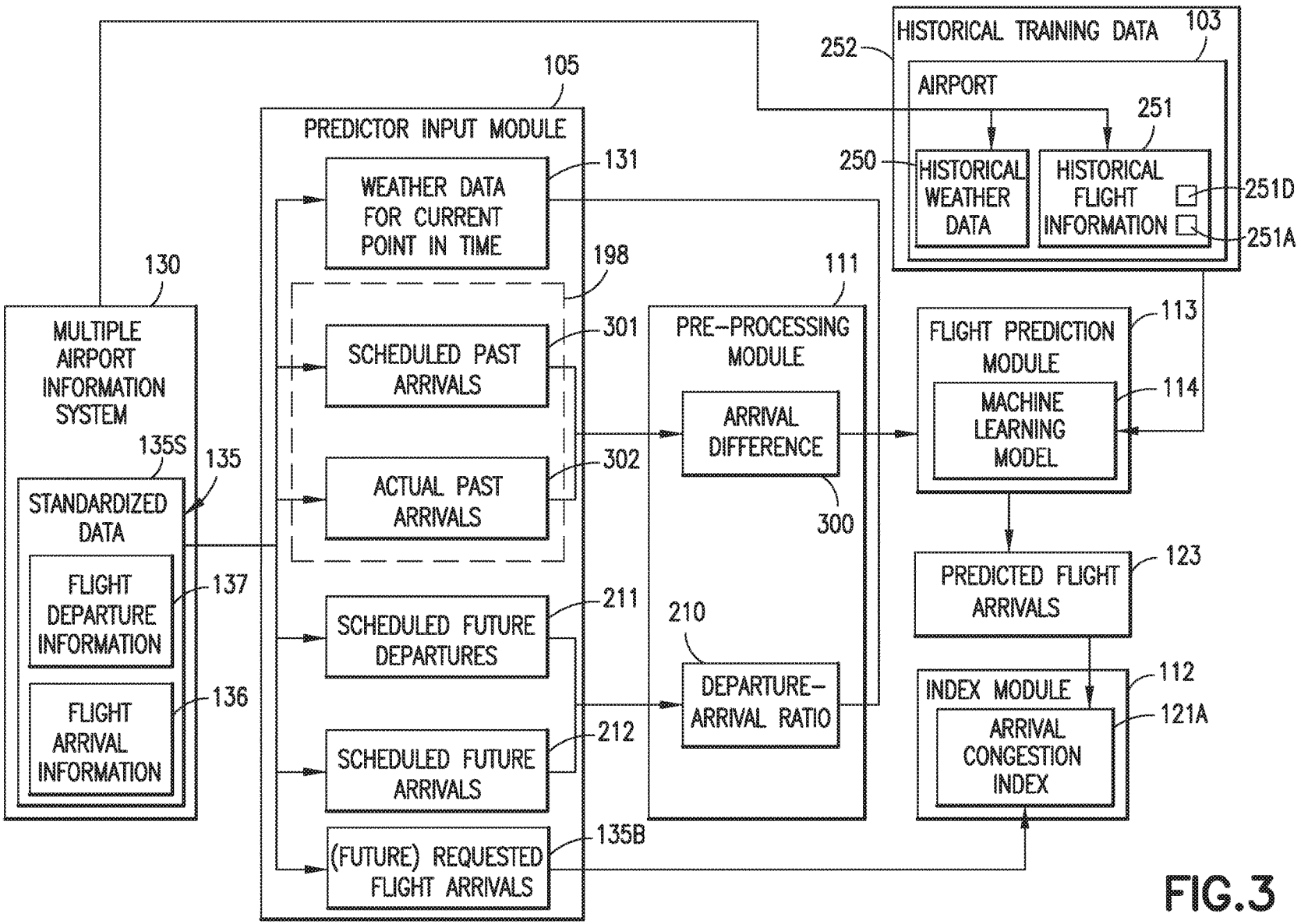

The airport congestion detection apparatus 100 may raise alerts, based on a congestion index 121 (that comprises one or more of a departure congestion index 121D and an arrival congestion index 121A, which are shown in FIGS. 2 and 3, respectively), that facilitate a modification of a fight plan characteristic and aids in flight operations such as air navigation planning 102P. For example, modification of a flight plan characteristic may include the generation of a new flight plan or a modification of an existing flight plan that will be followed by a pilot of the aircraft 500. In one aspect, the new or modified flight plan may be generated by ground based air traffic controllers or dispatchers based on the congestion index 121 or under a suggestion of the pilot of the aircraft 500 (where the suggestion is based on the congestion index 121) where the pilot commands the aircraft. 500 to enter a holding pattern at the predetermined airport 103, land at a suitable airport (e.g., an alternate destination airport that may not have any arrival delays), and/or delay takeoff of the aircraft 500. It is noted that the pilot may command the aircraft 500 to land at the alternate destination airport, so that the aircraft does not enter a holding pattern at the predetermined airport 103 for an extensive duration of time where the pilot may eventually be instructed to command the aircraft 500 to land at an airport that may negatively impact the travel of the passengers onboard the aircraft (e.g., require the passengers to take busses to their intended destination, board another flight to take them to their intended destination, etc.). The airport congestion detection apparatus 100 may also raise alerts, based on a congestion index 121, that facilitate the modification of an aircraft loading characteristic. For example, if the congestion index 121 for the predetermined airport to which the aircraft is flying indicates the aircraft will be in a holding pattern, the pilot may instruct airport ground crew to load the aircraft 500 with a greater amount of fuel 502 (FIG. 5) or passenger provisions 501 (FIG. 5) than would otherwise be loaded into the aircraft were it not for the holding pattern. The aspects of the present disclosure may also enable airline operators and/or pilots to predict air traffic control commands issued by air traffic controllers at the predetermined airport. For example, an indication of congestion at the predetermined airport may allow the airline operator and/or pilots to predict whether or not a holding pattern and/or alternate destination airport will be commanded by air traffic control when the aircraft enters the airspace around the predetermined airport 103.

In accordance with aspects of the present disclosure, the airport congestion detection apparatus 100 uses as inputs for determining predicted flight arrivals and departures a decreased number of inputs (e.g. predictors) compared to conventional air navigation planning tools. For example, the aspects of the present disclosure utilize general flight information from an historical predetermined time period 198 (such as, e.g., about 5 hours prior to congestion determination) to predict future arrivals and departures for a future predetermined time period 199 (such as, e.g., about twelve hours). In the aspects of the present disclosure, the difference between the number of scheduled departures and actual departures and/or the difference between the number of scheduled arrivals and actual arrivals for the historical predetermined time period 198 may be the best predictor of the number of actual arrivals and departures for the future predetermined time period for the determination of airport congestion. In addition, the airport congestion detection apparatus 100 uses, as inputs, data that is readily available (noting that conventional air navigation planning may be made using difficult to obtain information).

Still referring to FIG. 1, the airport congestion detection apparatus includes a predictor input module 105, a controller 110 and a user interface 120. The predictor input module 105 may be part of the controller 110 or separate from but coupled to the controller 110 (e.g., the predictor input module includes its own processor, memory, non-transient program code, etc.). The predictor input module 105 is coupled to a multiple airport information system 130. The multiple airport information system 130 is configured to provide weather data 131 and flight information 135 to a plurality of airports where the weather data 131 and flight information 135 corresponds to the plurality of airports. One example, of a multiple airport information system is the System Wide Information Management (SWIM) program established by the Federal Aviation Administration (FAA) for the National Airspace System (NAS). The SWIM program facilitates data sharing between airports and offers a single point of access for aviation data. The predictor input module 105 is configured to, by itself or under the command of the controller 110, obtain from the multiple airport information system 130 weather data 131 for a current point in time and flight information 135 for a predetermined airport 103. As used herein the "current point in time" refers to substantially at the instance the weather data is obtained from the multiple airport information system 130 and for which instance an airport congestion determination is made.

Referring to FIGS. 1, 2, and 3, examples of weather data 131 obtained by the predictor input module 105 from the multiple airport information system 130 include a current time 131A, a current date 131B, a current month 131C, wind data 131D, visibility data 131E, ceiling data 131F, temperature data 131G, and dew point data 131H. Examples of flight information 135 obtained by the predictor input module 105 from the multiple airport information system 130 include flight arrival information 136 and flight departure information 137, which may be in the form of real-time (e.g., about fifteen minutes or less) standardized data 135S formatted so as to be commonly understandable by the plurality of airports within the NAS.

Referring to FIGS. 1 and 2, the controller 110 is coupled to the predictor input module 105 and is configured to determine one or more of a number of predicted flight departures 122 from the predetermined airport 103 and a number of predicted flight arrivals 123 to the predetermined airport 103 within a future predetermined time period 199 based on the weather data 131 for the current point in time and the flight information 135. The controller 110 may be configured to determine the number of predicted flight departures 122 from the predetermined airport 103 within the future predetermined time period 199, based on the weather data 131 for the current point in time and the flight information 135, for aiding air navigation planning 102P at the predetermined airport 103. The controller 110 may also be configured to determine the number of predicted flight arrivals 123 to the predetermined airport 103 within the future predetermined time period 199, based on the weather data 131 for the current point in time and the flight information 135, for aiding air navigation planning 102P at the predetermined airport 103.

To determine the number of predicted flight departures 122, the controller 110 includes a pre-processing module 111 that is configured to determine, from the flight information 135, a departure difference 200 and a departure-arrival ratio 210. The departure difference 200 is a difference between a number of flights scheduled to depart 201 from the predetermined airport 103 for an historical predetermined time period 198 (referred to in FIG. 2 for descriptive purposes and also referred to herein as, i.e., scheduled past departures 201) and a number of flights that actually departed 202 from the predetermined airport 103 for the historical predetermined time period 198 (referred to in FIG. 2 for descriptive purposes and also referred to herein as, i.e., actual past departures 202). The historical predetermined time period 198 is, in one aspect, about five hours prior to the current point in time and ending at the current point in time, while in other aspects, the historical predetermined time period 198 may be more or less than about five hours. The departure-arrival ratio 210 is a ratio of a number of flights scheduled to depart 211 from the predetermined airport 103 (referred to in FIG. 2 for descriptive purposes and also referred to herein as, i.e., scheduled future departures 211) to a number of flights scheduled to arrive 212 at the predetermined airport 103 (referred to in FIG. 2 for descriptive purposes and also referred to herein as, i.e., scheduled future arrivals 212) for the future predetermined time period 199 beginning at the current point in time. In one aspect, the future predetermined time period 199 is about twelve hours from the current point in time, while in other aspects, the future predetermined time period 199 is more or less than about twelve hours from the current point in time.

The controller 110 also includes a flight prediction module 113. The flight prediction module 113 includes a machine learning model 114 that is trained/configured, in any suitable manner, to determine the number of predicted flight departures 122 from the predetermined airport 103 within the future predetermined time period 199 based on the weather data 131 for the current point in time and the flight information 135. In one aspect, the machine learning model 114 is a linear regression model 114A, a bootstrap regression model 114B or a Markov model 114C; however, in other aspects, any suitable machine learning model may be employed. The machine learning model 114 may be trained, for each airport 103, using historical training data 252 that includes historical weather data 250 and historical flight information 251 that corresponds to the historical weather data 250 for the respective airport 103. The historical flight information 251 includes historical flight departure data 251D (e.g., historical scheduled departures and historical actual departures), historical flight arrival data 251A (e.g., historical scheduled arrivals and historical actual arrivals, historical departure-arrival ratios (which are substantially similar to departure-arrival ratio 210 and are determined by the airport congestion detection apparatus 100 for training the machine learning model 114) and historical departure differences and historical arrival differences (which are substantially similar to the departures difference 200 (FIG. 2) and the arrival difference 300 (FIG. 3) respectively, and are determined by the airport congestion detection apparatus 100 for training the machine learning model 114). The machine learning model 114 is periodically retrained for each predetermined airport using accumulated historical weather data 250 and historical flight information 251 for each respective predetermined airport 103. For example, the scheduled past departures 201, the actual past departures 202, the scheduled past arrivals 301, and the actual past arrivals 302 may be added to the historical flight information 251 for the periodic retraining of machine learning model 114. The flight prediction module 113 uses as inputs to the machine learning model 114 the weather data 131 for the current point in time, the departure difference 200, and the departure-arrival ratio 210 and is configured to determine the predicted flight departures 122 based on these inputs and the training of the machine learning model 114.

The controller 110 includes an index module 112 that is configured to determine a departure congestion index 121D component of the congestion index 121. For example, with respect to flight departures, the index module 112 is configured to determine the departure congestion index 121D for a predetermined airport 103 for the future predetermined time period 199 based on the predicted flight departures 122, for the future predetermined time period 199, and a number of requested flight departures 135A (as determined from, e.g., an aggregation of flight plans), for the future predetermined time period 199. The departure congestion index 121D is defined as the requested flight departures 135A minus the predicted flight departures 122. The departure congestion index 121D may be a positive or negative integer. A zero or negative departure congestion index 121D indicates that there is substantially no congestion, with respect to aircraft departures, at the predetermined airport 103. A positive departure congestion index 121D indicates congestion, with respect to aircraft departures, at the predetermined airport where the higher the positive number the greater the congestion. The departure congestion index 121D may be tracked over time to establish a relationship between the departure congestion index 121D and ground delays at the predetermined airport 103 to assist in formulating ground delay programs at the predetermined airport and for aiding air navigation planning 102P at the predetermined airport 103.

Referring to FIGS. 1 and 3, to determine the number of predicted flight arrivals 123, the pre-processing module 111 of controller 110 is configured to determine, from the flight information 135, an arrival difference 300 and the departure-arrival ratio 210 (described above). The arrival difference 300 is a difference between a number of flights scheduled to arrive 301 from the predetermined airport 103 for the historical predetermined time period 198 (referred to in FIG. 3 for descriptive purposes and also referred to herein as, i.e., scheduled past arrivals 301) and a number of flights that actually arrived 302 at the predetermined airport 103 for the historical predetermined time period 198 (referred to in FIG. 3 for descriptive purposes and also referred to herein as, i.e., actual past arrivals 302).

As noted above, the flight prediction module 113 of the controller 110 includes the machine learning model 114 that is also trained/configured to determine the number of predicted flight arrivals 123 from the predetermined airport 103 within the future predetermined time period 199 based on the weather data 131 for the current point in time and the flight information 135. In a manner similar to that described above, the machine learning model 114 may be trained, for each airport 103, using historical training data 252 that includes the historical weather data 250 and the historical flight information 251 that corresponds to the historical weather data 250 for the respective airport 103. The flight prediction module 113 uses as inputs to the machine learning model 114 the weather data 131 for the current point in time, the arrival difference 300, and the departure-arrival ratio 210 and is configured to determine the predicted flight arrivals 123 based on these inputs and the training of the machine learning model 114.

The index module 112 of the controller 110 is configured to determine an arrival congestion index 121A component of the congestion index 121. For example, with respect to flight arrivals, the index module 112 is configured to determine the arrival congestion index 121A for a predetermined airport 103 for the future predetermined time period 199 based on the predicted flight arrivals 123, for the future predetermined time period 199, and a number of requested flight arrivals 135B (as determined from, e.g., an aggregation of flight plans), for the future predetermined time period 199. The arrival congestion index 121A is defined as the requested flight arrivals 135B minus the predicted flight arrivals 123. The arrival congestion index 121A may be a positive or negative integer. A zero or negative arrival congestion index 121A indicates that there is substantially no congestion, with respect to aircraft arrivals, at the predetermined airport 103. A positive arrival congestion index 121A indicates congestion, with respect to aircraft arrivals, at the predetermined airport 103 where the higher the positive number the greater the congestion. The arrival congestion index 121A may be tracked over time to establish a relationship between the arrival congestion index 121A and holding pattern delays at the predetermined airport 103 to assist with air navigation planning 102P at the predetermined airport 103.

In one aspect, the future predetermined time period 199 is divided into predetermined time intervals T1-Tn and the controller 110 is configured to determine one or more of the number of predicted flight departures 122 from the predetermined airport 103 and the number of predicted flight arrivals 123 to the predetermined airport 103 for each predetermined time interval T1-Tn. Here, the controller 110 is configured to determine the departure congestion index 121D and the arrival congestion index 121A of the congestion index 121 for the predetermined airport 103 for each predetermined time interval T1-Tn of the future predetermined time period 199. This time interval T1-Tn determination of the congestion index. 121 may aid in air navigation planning 102P by providing an increased granularity of congestion at the predetermined airport 103.

As described above, referring to FIGS. 1 and 5, the airport congestion detection apparatus 10 includes the user interface 120 which is coupled to the controller 110. The user interface 120 may be any suitable user interface, such as a graphical user interface. In one aspect, where the airport congestion detection apparatus 100 is employed in the aircraft 500 the user interface 120 may be a user interface of a flight control system 500CONT in the cockpit of the aircraft 500. In another aspect, the airport congestion detection apparatus 100 is employed in an aircraft flight planning apparatus 101 of an airline operator or in an air navigation planning apparatus 102 for assisting air traffic controllers with air navigation planning 102P at an airport. The user interface 120 may be a user interface of the aircraft flight planning apparatus 101 or the air navigation planning apparatus 102. The user interface 120 is configured to present to an operator of the airport congestion detection apparatus 100 the congestion index 121 (e.g., one or more of the departure congestion index 121D and the arrival congestion index 121A) so that one or more of a flight plan characteristic 140 or an aircraft loading characteristic 150 for the aircraft 500 (FIG. 5) is modified based on the congestion index 121. The flight plan characteristic 140 includes one or more of an aircraft cruise time period 140A, a length of an aircraft holding pattern 140B, an arrival airport 140C, a length of time an aircraft is held on the ground 140D prior to take off relative to a scheduled departure time, and any other suitable flight characteristics where a change in the flight plan characteristic 140 affects air traffic control planning for the predetermined airport 103. The aircraft loading characteristic 150 includes one or more of an amount of fuel 502 carried by the aircraft and an amount of passenger provisions 501 stored within an interior 500INT of the aircraft 500 that facilitates prolonged flight time and passenger comfort during in flight delays due to airport congestion.

Referring now to FIGS. 2, 3, and 4, an airport congestion determination method 400 will be described in accordance with aspects of the present disclosure. In the method 400, the weather data 131 for the current point in time and the flight information 135 for the predetermined airport 103 are obtained, with the predictor input module 105, from the multiple airport information system 130 (FIG. 4, Block 401). One or more of the number of predicted flight departures 122 from the predetermined airport 103 and the number of predicted flight arrivals 123 to the predetermined airport. 103 are determined (FIG. 4, Blocks 405 and 406), with the controller 110 in the manner described above, within the future predetermined time period 109 based on the weather data 131 for the cumin point in time and the flight information 135. The congestion index 121 (including one or more of the departure congestion index 121D and the arrival congestion index 121A) is determined (FIG. 4, Block 410), with the controller 110, for the predetermined airport 103 based on one or more of the number of predicted flight departures 122 and the number of requested flight departures 135A from the predetermined airport 103, and the number of predicted flight arrivals 123 and the number of requested flight arrivals 135B from the predetermined airport 103. The congestion index 121 is presented (FIG. 4, Block 415) to an operator, through the user interface 120, so that the one or more of the flight plan characteristic 140 and the aircraft loading characteristic 150 is modified (FIG. 4, Blocks 420 and 421) based on the congestion index 121 as described above. As also described above, modification of the flight plan characteristic 140 may assist or otherwise affect air navigation planning (FIG. 4, Block 425) at the predetermined airport 103 such that pilot instructions received from air traffic control are changed compared to an original flight plan previously received by the pilot from (or submitted by the pilot to) air traffic control.

The following are provided in accordance with the aspects of the present disclosure:

A1. An airport congestion detection apparatus comprising:

a predictor input module coupled to a multiple airport information system, the predictor input module being configured to obtain from the multiple airport information system weather data for a current point in time and flight information for a predetermined airport;

a controller coupled to the predictor input module, the controller being configured to determine one or more of a number of predicted flight departures from the predetermined airport and a number of predicted flight arrivals to the predetermined airport within a future predetermined time period based on the weather data for the current point in time and the flight information, and determine a congestion index for the predetermined airport based on one or more of the number of predicted flight departures and a number of requested flight departures from the predetermined airport, and the number of predicted flight arrivals and a number of requested flight arrivals to the predetermined airport and a user interface coupled to the controller, the user interface being configured to present to an operator of the airport congestion detection apparatus the congestion index so that one or more of a flight plan characteristic or an aircraft loading characteristic is modified based on the congestion index.

A2. The airport congestion detection apparatus of paragraph A1, wherein the weather data for the current point in time includes a current time, a current date, a current month and one or more of wind data, visibility data, ceiling data, temperature data, and dew point data.

A3. The airport congestion detection apparatus of paragraph A1, wherein the future predetermined time period is divided into a plurality of predetermined time intervals and the controller is configured to determine the one or more of the number of predicted flight departures from the predetermined airport and the number of predicted flight arrivals to the predetermined airport for each of the plurality of predetermined time intervals.

A4. The airport congestion detection apparatus of paragraph A3, wherein the controller is configured to determine the congestion index for the predetermined airport for each of the plurality of predetermined time intervals.

A5. The airport congestion detection apparatus of paragraph A1, wherein the future predetermined time period is about twelve hours from the current point in time.

A6. The airport congestion detection apparatus of paragraph A1, wherein the controller is configured to determine, from the flight information, one or more of a difference between a number of flights scheduled to depart from the predetermined airport and a number of flights that actually departed from the predetermined airport for an historical predetermined time period ending at the current point in time, and a difference between a number of flights scheduled to arrive at the predetermined airport and a number of flights that actually arrived at the predetermined airport for the historical predetermined time period ending at the current point in time.

A7. The airport congestion detection apparatus of paragraph A6, wherein the historical predetermined time period is about five hours prior to the current point in time.

A8. The airport congestion detection apparatus of paragraph A1, wherein the controller is configured to determine, from the flight information, a ratio of a number of flights scheduled to depart from the predetermined airport to a number of flights scheduled to arrive at the predetermined airport for the future predetermined time period beginning at the current point in time.

A9. The airport congestion detection apparatus of paragraph A8, wherein the future predetermined time period is about twelve hours from the current point in time.

A10. The airport congestion detection apparatus of paragraph A1, wherein the controller includes a machine learning model configured to determine one or more of the number of predicted flight departures from the predetermined airport within the future predetermined time period based on the weather data for the current point in time and the flight information, and the number of predicted flight arrivals to the predetermined airport within the future predetermined time period based on the weather data for the current point in time and the flight information.

A11. The airport congestion detection apparatus of paragraph A10, wherein the machine learning model is periodically retrained using accumulated historical weather data and historical flight information for the predetermined airport.

A12. The airport congestion detection apparatus of paragraph A10, wherein the machine learning model comprises a linear regression model, a bootstrap regression model, or a Markov model.

A13. The airport congestion detection apparatus of paragraph A1, wherein the flight plan characteristic is one or more of an aircraft cruise time period, a length of an aircraft holding pattern, an arrival airport, and a length of time an aircraft is held on the ground prior to take off relative to a scheduled departure time, where a change in the flight plan characteristic affects air navigation planning for the predetermined airport.

A14. The airport congestion detection apparatus of paragraph A1, wherein the aircraft loading characteristic comprises an amount of fuel carried by an aircraft.

A15. The airport congestion detection apparatus of paragraph A1, wherein the congestion index comprises one or more of a departure congestion index and an arrival congestion index.

A16. The airport congestion detection apparatus of paragraph A1, wherein the flight information comprises one or more of flight departure information and flight arrival information.

A17. The airport congestion detection apparatus of paragraph A1, wherein the controller is further configured to determine the number of predicted flight arrivals to the predetermined airport within the future predetermined time period, based on the weather data for the current point in time and the flight information, for aiding air navigation planning at the predetermined airport.

A18. The airport congestion detection apparatus of paragraph A1, wherein the controller is further configured to determine the number of predicted flight departures from the predetermined airport within the future predetermined time period, based on the weather data for the current point in time and the flight information, for aiding air navigation planning at the predetermined airport.

B1. An aircraft air navigation planning apparatus comprising:

a predictor input module coupled to a multiple airport information system, the predictor input module being configured to obtain from the multiple airport information system weather data for a current point in time and flight information for a predetermined airport;

a flight prediction module configured to determine one or more of a number of predicted flight departures from the predetermined airport and a number of predicted flight arrivals to the predetermined airport within a future predetermined time period based on the weather data for the current point in time and the flight information, and a controller coupled to the flight prediction module, the controller being configured to determine a congestion index for the predetermined airport based on one or more of the number of predicted flight departures and a number of requested flight departures from the predetermined airport, and the number of predicted flight arrivals and a number of requested flight arrivals to the predetermined airport; and a user interface coupled to the controller, the user interface being configured to present to an operator of the aircraft flight planning apparatus the congestion index so that one or more of a flight plan characteristic or an aircraft loading characteristic is modified based on the congestion index.

B2. The aircraft air navigation planning apparatus of paragraph B1, wherein the weather data for the current point in time includes a current time, a current date, a current month and one or more of wind data, visibility data, ceiling data, temperature data, and dew point data.

B3. The aircraft air navigation planning apparatus of paragraph B1, wherein the future predetermined time period is divided into a plurality of predetermined time intervals and the flight prediction module is configured to determine the one or more of the number of predicted flight departures from the predetermined airport and the number of predicted flight arrivals to the predetermined airport for each of the plurality of predetermined time intervals.

B4. The aircraft air navigation planning apparatus of paragraph B3, wherein the controller is configured to determine the congestion index for the predetermined airport for each of the plurality of predetermined time intervals.

B5. The aircraft air navigation planning apparatus of paragraph B1, wherein the future predetermined time period is about twelve hours from the current point in time.

B6. The aircraft air navigation planning apparatus of paragraph B1, wherein the controller is configured to determine, from the flight information, one or more of a difference between a number of flights scheduled to depart from the predetermined airport and a number of flights that actually departed from the predetermined airport for an historical predetermined time period ending at the current point in time, and a number of flights scheduled to arrive at the predetermined airport and a number of flights that actually arrived at the predetermined airport for the historical predetermined time period ending at the current point in time.

B7. The aircraft air navigation planning apparatus of paragraph B6, wherein the historical predetermined time period is about five hours prior to the current point in time.

B8. The aircraft air navigation planning apparatus of paragraph B1, wherein the controller is configured to determine, from the flight information, a ratio of a number of flights scheduled to depart from the predetermined airport to a number of flights scheduled to arrive at the predetermined airport for the future predetermined time period beginning at the current point in time.

B9. The aircraft air navigation planning apparatus of paragraph B8, wherein the future predetermined time period is about twelve hours from the current point in time.

B10. The aircraft air navigation planning apparatus of paragraph B1, wherein the flight prediction module includes a machine learning model configured to determine one or more of the number of predicted flight departures from the predetermined airport within the future predetermined time period based on the weather data for the current point in time and the flight departure information and the number of predicted flight arrivals to the predetermined airport within the future predetermined time period based on the weather data for the current point in time and the flight departure information.

B11. The aircraft air navigation planning apparatus of paragraph B10, wherein the machine learning model is periodically retrained using accumulated historical weather data and historical flight information for the predetermined airport.

B12. The aircraft air navigation planning apparatus of paragraph B11, wherein the machine learning model comprises a linear regression model, a bootstrap regression model, or a Markov model.

B13. The aircraft air navigation planning apparatus of paragraph A1, wherein the flight plan characteristic is one or more of an aircraft cruise time period, a length of an aircraft holding pattern, an arrival airport, and a length of time an aircraft is held on the ground prior to take off relative to a scheduled departure time, where a change in the flight plan characteristic affects air navigation planning for the predetermined airport.

B14. The aircraft air navigation planning apparatus of paragraph A1, wherein the aircraft loading characteristic comprises an amount of fuel carried by an aircraft.

B15. The aircraft air navigation planning apparatus of paragraph A1, wherein the congestion index comprises one or more of a departure congestion index and an arrival congestion index.

B16. The aircraft air navigation planning apparatus of paragraph B1, wherein the flight information comprises one or more of flight departure information and flight arrival information.

B17. The aircraft air navigation planning apparatus of paragraph B1, wherein the flight prediction module is further configured to determine the number of predicted flight arrivals to the predetermined airport within the future predetermined time period, based on the weather data for the current point in time and the flight information, for aiding air navigation planning at the predetermined airport.

B18. The aircraft air navigation planning apparatus of paragraph B1, wherein the flight prediction module is further configured to determine the number of predicted flight departures from the predetermined airport within the future predetermined time period, based on the weather data for the current point in time and the flight information, for aiding air navigation planning at the predetermined airport.

C1. An airport congestion determination method comprising:

obtaining, with a predictor input module, from a multiple airport information system weather data for a current point in time and flight information for a predetermined airport;

determining, with a controller coupled to the predictor input module, one or more of a number of predicted flight departures from the predetermined airport and a number of predicted flight arrivals to the predetermined airport within a future predetermined time period based on the weather data for the current point in time and the flight information;

determining, with the controller, a congestion index for the predetermined airport based on one or more of the number of predicted flight departures and a number of requested flight departures from the predetermined airport, and the number of predicted flight arrivals and a number of requested flight arrivals from the predetermined airport; and presenting the congestion index to an operator, through a user interface, so that one or more of a flight plan characteristic or an aircraft loading characteristic is modified based on the congestion index.

C2. The method of paragraph C1, wherein the weather data for the current point in time includes a current time, a current date, a current month and one or more of wind data, visibility data, ceiling data, temperature data, and dew point data.

C3. The method of paragraph C1, wherein the future predetermined time period is divided into a plurality of predetermined time intervals and the one or more of the number of predicted flight departures from the predetermined airport and the number of predicted flight arrivals to the predetermined airport is determined for each of the plurality of predetermined time intervals.

C4. The method of paragraph C3, wherein the congestion index is determined for the predetermined airport for each of the plurality of predetermined time intervals.

C5. The method of paragraph C1, wherein the future predetermined time period is about twelve hours from the current point in time.

C6. The method of paragraph C1, further comprising determining, with the controller, from the flight information, one or more of a difference between a number of flights scheduled to depart from the predetermined airport and a number of flights that actually departed from the predetermined airport for an historical predetermined time period ending at the current point in time, and a difference between a number of flights scheduled to arrive at the predetermined airport and a number of flights that actually arrived at the predetermined airport for the historical predetermined time period ending at the current point in time.

C7. The method of paragraph C6, wherein the historical predetermined time period is about five hours prior to the current point in time.

C8. The method of paragraph C1, further comprising determining, with the controller, from the flight information a ratio of a number of flights scheduled to depart from the predetermined airport to a number of flights scheduled to arrive at the predetermined airport for the future predetermined time period beginning at the current point in time.

C9. The method of paragraph C8, wherein the future predetermined time period is about twelve hours from the current point in time.

C10. The method of paragraph C1, wherein a machine learning model determines one or more of the number of predicted flight departures from the predetermined airport within the future predetermined time period based on the weather data for the current point in time and the flight information, and the number of predicted flight arrivals to the predetermined airport within the future predetermined time period based on the weather data for the current point in time and the flight information.

C11. The method of paragraph C10, further comprising periodically retraining the machine learning model using accumulated historical weather data and historical flight information for the predetermined airport.

C12. The method of paragraph C11, wherein the machine learning model is one or more of a linear regression model, a bootstrap regression model, and a Markov model.

C13. The method of paragraph C1, wherein the flight plan characteristic is one or more of an aircraft cruise time period, a length of an aircraft holding pattern, an arrival airport, and a length of time an aircraft is held on the ground prior to take off relative to a scheduled departure time, the method further comprising planning air navigation for the predetermined airport based on the flight plan characteristic.

C14. The method of paragraph C1, wherein the aircraft loading characteristic comprises an amount of fuel carried by an aircraft.

C15. The method of paragraph C1, wherein the congestion index comprises one or more of a departure congestion index and an arrival congestion index.

C16. The method of paragraph C1, wherein the flight information comprises one or more of flight departure information and flight arrival information.

C17. The method of paragraph C1, wherein determining the number of predicted flight arrivals to the predetermined airport within the future predetermined time period, based on the weather data for the current point in time and the flight information, aids air navigation planning for the predetermined airport.

C18. The method of paragraph C1, wherein determining the number of predicted flight departures from the predetermined airport within the future predetermined time period, based on the weather data for the current point in time and the flight information, aids air navigation planning for the predetermined airport.

In the figures, referred to above, solid lines, if any, connecting various elements and/or components may represent mechanical, electrical, fluid, optical, electromagnetic, wireless and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIG. 4, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIG. 4, and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or substantially simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es), system(s), and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. An airport congestion detection apparatus comprising:

a predictor input processor module coupled to a multiple airport air traffic control information system the multiple airport air traffic control information system shares weather data and flight information between airports and, the predictor input processor module is configured to obtain from the multiple airport air traffic control information system the weather data for a current point in time and the flight information for a predetermined airport;

a controller coupled to the predictor input processor module, the controller being configured to determine one or more of a number of predicted flight departures from the predetermined airport and a number of predicted flight arrivals to the predetermined airport within a future predetermined time period based on the weather data for the current point in time and the flight information, and determine a congestion index for the predetermined airport, where the congestion index comprises one or more of a difference between the number of predicted flight departures and a number of requested flight departures from the predetermined airport, and a difference between the number of predicted flight arrivals and a number of requested flight arrivals to the predetermined airport; and a user interface coupled to the controller, the user interface being configured to present to an operator of the airport congestion detection apparatus the congestion index so that one or more of a flight plan characteristic or an aircraft loading characteristic is modified based on the congestion index.

2. The airport congestion detection apparatus of claim 1, wherein the future predetermined time period is divided into a plurality of predetermined time intervals and the controller is configured to determine the one or more of the number of predicted flight departures from the predetermined airport and the number of predicted flight arrivals to the predetermined airport for each of the plurality of predetermined time intervals.

3. The airport congestion detection apparatus of claim 2, wherein the controller is configured to determine the congestion index for the predetermined airport for each of the plurality of predetermined time intervals.

4. The airport congestion detection apparatus of claim 1, wherein the controller is configured to determine, from the flight information, one or more of a difference between a number of flights scheduled to depart from the predetermined airport and a number of flights that actually departed from the predetermined airport for an historical predetermined time period ending at the current point in time, and a difference between a number of flights scheduled to arrive at the predetermined airport and a number of flights that actually arrived at the predetermined airport for the historical predetermined time period ending at the current point in time.

5. The airport congestion detection apparatus of claim 4, wherein the historical predetermined time period is about five hours prior to the current point in time.

6. The airport congestion detection apparatus of claim 1, wherein the controller is configured to determine, from the flight information, a ratio of a number of flights scheduled to depart from the predetermined airport to a number of flights scheduled to arrive at the predetermined airport for the future predetermined time period beginning at the current point in time.

7. The airport congestion detection apparatus of claim 1, wherein the controller includes a machine learning model configured to determine one or more of the number of predicted flight departures from the predetermined airport within the future predetermined time period based on the weather data for the current point in time and the flight information, and the number of predicted flight arrivals to the predetermined airport within the future predetermined time period based on the weather data for the current point in time and the flight information.

8. The airport congestion detection apparatus of claim 1, wherein the flight plan characteristic is one or more of an aircraft cruise time period, a length of an aircraft holding pattern, an arrival airport, and a length of time an aircraft is held on the ground prior to take off relative to a scheduled departure time, where a change in the flight plan characteristic affects air navigation planning for the predetermined airport.

9. The airport congestion detection apparatus of claim 1, wherein the aircraft loading characteristic comprises an amount of fuel carried by an aircraft.

10. The airport congestion detection apparatus of claim 1, wherein the controller is further configured to determine the number of predicted flight arrivals to the predetermined airport within the future predetermined time period, based on the weather data for the current point in time and the flight information, for aiding air navigation planning at the predetermined airport.

11. The airport congestion detection apparatus of claim 1, wherein the controller is further configured to determine the number of predicted flight departures from the predetermined airport within the future predetermined time period, based on the weather data for the current point in time and the flight information, for aiding air navigation planning at the predetermined airport.

12. An aircraft air navigation planning apparatus comprising:

a predictor input processor module coupled to a multiple airport air traffic control information system, the multiple airport air traffic control information system shares weather data and flight information between airports and the predictor input module is configured to obtain from the multiple airport air traffic control information system weather data for a current point in time and flight information for a predetermined airport;

a flight prediction controller module configured to determine one or more of a number of predicted flight departures from the predetermined airport and a number of predicted flight arrivals to the predetermined airport within a future predetermined time period based on the weather data for the current point in time and the flight information, and a controller coupled to the flight prediction controller module, the controller being configured to determine a congestion index for the predetermined airport, where the congestion index comprises one or more of a difference between the number of predicted flight departures and a number of requested flight departures from the predetermined airport, and a difference between the number of predicted flight arrivals and a number of requested flight arrivals to the predetermined airport; and a user interface coupled to the controller, the user interface being configured to present to an operator of the aircraft flight planning apparatus the congestion index so that one or more of a flight plan characteristic or an aircraft loading characteristic is modified based on the congestion index.

13. The aircraft air navigation planning apparatus of claim 12, wherein the controller is configured to determine, from the flight information, one or more of a difference between a number of flights scheduled to depart from the predetermined airport and a number of flights that actually departed from the predetermined airport for an historical predetermined time period ending at the current point in time, and a difference between a number of flights scheduled to arrive at the predetermined airport and a number of flights that actually arrived at the predetermined airport for the historical predetermined time period ending at the current point in time.

14. The aircraft air navigation planning apparatus of claim 12, wherein the controller is configured to determine, from the flight information, a ratio of a number of flights scheduled to depart from the predetermined airport to a number of flights scheduled to arrive at the predetermined airport for the future predetermined time period beginning at the current point in time.

15. The aircraft air navigation planning apparatus of claim 12, wherein the flight prediction controller module includes a machine learning model configured to determine one or more of the number of predicted flight departures from the predetermined airport within the future predetermined time period based on the weather data for the current point in time and the flight departure information; and the number of predicted flight arrivals to the predetermined airport within the future predetermined time period based on the weather data for the current point in time and the flight departure information.

16. An airport congestion determination method comprising:

obtaining, with a predictor input processor module, from a multiple airport air traffic control information system, weather data for a current point in time and flight information for a predetermined airport, where the multiple airport air traffic control information system shares weather data and flight information between airports;

determining, with a controller coupled to the predictor input processor module, one or more of a number of predicted flight departures from the predetermined airport and a number of predicted flight arrivals to the predetermined airport within a future predetermined time period based on the weather data for the current point in time and the flight information;

determining, with the controller, a congestion index for the predetermined airport where the congestion index comprises one or more of a difference between the number of predicted flight departures and a number of requested flight departures from the predetermined airport, and a difference between the number of predicted flight arrivals and a number of requested flight arrivals from the predetermined airport; and presenting the congestion index to an operator, through a user interface, so that one or more of a flight plan characteristic or an aircraft loading characteristic is modified based on the congestion index.

17. The airport congestion determination method of claim 16, further comprising determining, with the controller, from the flight information, one or more of a difference between a number of flights scheduled to depart from the predetermined airport and a number of flights that actually departed from the predetermined airport for an historical predetermined time period ending at the current point in time, and a difference between a number of flights scheduled to arrive at the predetermined airport and a number of flights that actually arrived at the predetermined airport for the historical predetermined time period ending at the current point in time.

18. The airport congestion determination method of claim 16, wherein a machine learning model determines one or more of the number of predicted flight departures from the predetermined airport within the future predetermined time period based on the weather data for the current point in time and the flight information, and the number of predicted flight arrivals to the predetermined airport within the future predetermined time period based on the weather data for the current point in time and the flight information.

19. The airport congestion determination method of claim 16, wherein determining the number of predicted flight arrivals to the predetermined airport within the future predetermined time period, based on the weather data for the current point in time and the flight information, aids air navigation planning for the predetermined airport.

20. The airport congestion determination method of claim 16, wherein determining the number of predicted flight departures from the predetermined airport within the future predetermined time period, based on the weather data for the current point in time and the flight information, aids air navigation planning for the predetermined airport.

* * * * *